US011427997B2

(12) United States Patent
Brill et al.

(10) Patent No.: US 11,427,997 B2
(45) Date of Patent: Aug. 30, 2022

(54) LOW PROFILE DRAIN

(71) Applicant: INFINITY DRAIN LTD., Amityville, NY (US)

(72) Inventors: Jonathan Brill, Amityville, NY (US); Bhasnarine Ramkarran, Amityville, NY (US)

(73) Assignee: INFINITY DRAIN LTD, Amityville, NY (US)

( * ) Notice: Subject to any disclaimer, the term of this patent is extended or adjusted under 35 U.S.C. 154(b) by 0 days.

(21) Appl. No.: 17/070,199

(22) Filed: Oct. 14, 2020

(65) Prior Publication Data

US 2021/0115655 A1 Apr. 22, 2021

Related U.S. Application Data

(60) Provisional application No. 62/916,568, filed on Oct. 17, 2019.

(51) Int. Cl.
*E03F 5/04* (2006.01)
*A47K 3/40* (2006.01)

(52) U.S. Cl.
CPC ..... *E03F 5/0408* (2013.01); *A47K 3/405* (2013.01)

(58) Field of Classification Search
CPC ..... E03F 5/0408; E03F 5/0407; A47K 3/405
USPC ..... 4/613
See application file for complete search history.

(56) References Cited

U.S. PATENT DOCUMENTS

| | | | | |
|---|---|---|---|---|
| 2016/0130794 | A1* | 5/2016 | Erlebach | E03F 5/0408 4/613 |
| 2018/0038091 | A1* | 2/2018 | Ismert | E03F 5/0401 |
| 2021/0040721 | A1* | 2/2021 | Larson | E03F 5/0408 |

* cited by examiner

*Primary Examiner* — Huyen D Le
(74) *Attorney, Agent, or Firm* — F. Chau & Associates, LLC

(57) ABSTRACT

A low profile drain includes a first extrusion channel extending lengthwise in a first direction, a second extrusion channel extending lengthwise in the first direction, and a connection channel extending lengthwise in the first direction. The connection channel is configured to interlock with an end of the first extrusion channel via a first interlocking mechanism, and interlock with an end of the second extrusion channel via a second interlocking mechanism. The first interlocking mechanism includes at least one first angular protrusion disposed on the first extrusion channel, and a first angular recess disposed on the connection channel. The at least one first angular protrusion is configured to interlock with the first angular recess.

20 Claims, 4 Drawing Sheets

LOW PROFILE DRAIN

CROSS-REFERENCE TO RELATED APPLICATIONS

This application claims priority to and the benefit of U.S. Provisional Application Ser. No. 62/916,568 filed on Oct. 17, 2019, the disclosure of which is herein incorporated by reference in its entirety.

TECHNICAL FIELD

Exemplary embodiments of the present invention relate to a drain, and more particularly, a low profile drain designed for improved installation.

DISCUSSION OF THE RELATED ART

A low profile drain is a drain that sits flush within the floor after installation. A low profile drain may be, for example, a linear drain having a channel-shaped body, through which a liquid such as, for example, water, flows through to be drained. A linear drain may be positioned, for example, along a wall or along the threshold of a shower enclosure. Linear drains have become an important element in the overall design of bathrooms and wet rooms, as well as in outdoor applications.

A linear drain is typically installed in a floor by creating a mortar bed (also referred to as a cement bed or a mud bed) that extends the length of a drain channel of the linear drain, and by backfilling the underside of the drain channel. The mortar bed is used to level the linear drain, and to secure the linear drain in the floor.

SUMMARY

According to an exemplary embodiment of the present invention, a low profile drain includes a first extrusion channel extending lengthwise in a first direction, a second extrusion channel extending lengthwise in the first direction, and a connection channel extending lengthwise in the first direction. Each of the first extrusion channel and the second extrusion channel includes a lower surface, a first sidewall extending upward from the lower surface in a second direction crossing the first direction, and a second sidewall opposing the first sidewall and extending upward from the lower surface in the second direction. The connection channel includes a lower surface, a first sidewall extending upward from the lower surface of the connection channel in the second direction, and a second sidewall opposing the first sidewall of the connection channel and extending upward from the lower surface of the connection channel in the second direction. The connection channel is configured to interlock with an end of the first extrusion channel via a first interlocking mechanism, and interlock with an end of the second extrusion channel via a second interlocking mechanism.

In an exemplary embodiment, the first interlocking mechanism includes a first angular protrusion disposed on an outer surface of the first sidewall of the first extrusion channel, a second angular protrusion disposed on the outer surface of the first sidewall of the first extrusion channel, and a first angular recess disposed on an inner surface of the first sidewall of the connection channel. The first and second angular protrusions extend away from each other as the first and second angular protrusions protrude away from the outer surface of the first sidewall of the first extrusion channel, and a first space exists between the first and second angular protrusions. The first and second angular protrusions are configured to interlock with the first angular recess.

In an exemplary embodiment, the first interlocking mechanism further includes a third angular protrusion disposed on an outer surface of the second sidewall of the first extrusion channel, a fourth angular protrusion disposed on the outer surface of the second sidewall of the first extrusion channel, and a second angular recess disposed on an inner surface of the second sidewall of the connection channel. The third and fourth angular protrusions extend away from each other as the third and fourth angular protrusions protrude away from the outer surface of the second sidewall of the first extrusion channel, and a second space exists between the third and fourth angular protrusions. The third and fourth angular protrusions are configured to interlock with the second angular recess.

In an exemplary embodiment, the second interlocking mechanism includes a fifth angular protrusion disposed on an outer surface of the first sidewall of the second extrusion channel, a sixth angular protrusion disposed on the outer surface of the first sidewall of the second extrusion channel, and a third angular recess disposed on the inner surface of the first sidewall of the connection channel. The fifth and sixth angular protrusions extend away from each other as the fifth and sixth angular protrusions protrude away from the outer surface of the first sidewall of the second extrusion channel, and a third space exists between the fifth and sixth angular protrusions. The fifth and sixth angular protrusions are configured to interlock with the third angular recess.

In an exemplary embodiment, the second interlocking mechanism further includes a seventh angular protrusion disposed on an outer surface of the second sidewall of the second extrusion channel, an eighth angular protrusion disposed on the outer surface of the second sidewall of the second extrusion channel, and a fourth angular recess disposed on the inner surface of the second sidewall of the connection channel. The seventh and eighth angular protrusions extend away from each other as the seventh and eighth angular protrusions protrude away from the outer surface of the second sidewall of the second extrusion channel, and a fourth space exists between the seventh and eighth angular protrusions. The seventh and eighth angular protrusions are configured to interlock with the fourth angular recess.

In an exemplary embodiment, a width of the first space between the first and second angular protrusions increases as the first and second angular protrusions protrude away from the outer surface of the first sidewall of the first extrusion channel.

In an exemplary embodiment, the first angular recess is shaped and dimensioned to receive the first and second angular protrusions.

In an exemplary embodiment, a first angle formed between a side surface of the first angular protrusion and the outer surface of the first sidewall of the first extrusion channel is less than about 90 degrees.

In an exemplary embodiment, a second angle formed between a side surface of the second angular protrusion and the outer surface of the first sidewall of the first extrusion channel is less than about 90 degrees.

In an exemplary embodiment, a first angle formed between a side surface of the first angular protrusion and the outer surface of the first sidewall of the first extrusion channel is about 45 degrees.

In an exemplary embodiment, a second angle formed between a side surface of the second angular protrusion and the outer surface of the first sidewall of the first extrusion channel is about 45 degrees.

In an exemplary embodiment, the first space has a triangular shape.

In an exemplary embodiment, the connection channel further includes a hole disposed in the lower surface of the connection channel.

In an exemplary embodiment, the low profile drain further includes a lip extending upward from the lower surface of the connection channel, in which the lip is disposed between the hole and an end of the connection channel.

In an exemplary embodiment, the low profile drain further includes a lip extending upward from the lower surface of the connection channel, in which the lip is disposed between the hole and an angular recess formed in an inner surface of the first sidewall of the connection channel.

According to an exemplary embodiment of the present invention, a low profile drain includes a first extrusion channel extending lengthwise in a first direction, a second extrusion channel extending lengthwise in the first direction, and a connection channel extending lengthwise in the first direction. The connection channel is configured to interlock with an end of the first extrusion channel via a first interlocking mechanism, and interlock with an end of the second extrusion channel via a second interlocking mechanism. The first interlocking mechanism includes at least one first angular protrusion disposed on the first extrusion channel, and a first angular recess disposed on the connection channel. The at least one first angular protrusion is configured to interlock with the first angular recess.

In an exemplary embodiment, the second interlocking mechanism includes at least one second angular protrusion disposed on the second extrusion channel, and a second angular recess disposed on the connection channel. The at least one second angular protrusion is configured to interlock with the second angular recess.

In an exemplary embodiment, at least one first angular protrusion is disposed on an outer surface of the first extrusion channel, and the first angular recess is disposed on an inner surface of the connection channel. The at least one second angular protrusion is disposed on an outer surface of the second extrusion channel, and the second angular recess is disposed on the inner surface of the connection channel.

According to an exemplary embodiment of the present invention, a low profile drain includes an extrusion channel extending lengthwise in a first direction, and a connection channel extending lengthwise in the first direction. The connection channel is configured to interlock with an end of the extrusion channel via an interlocking mechanism. The interlocking mechanism includes at least one angular protrusion disposed on the extrusion channel, and an angular recess disposed on the connection channel. The at least one angular protrusion is configured to interlock with the angular recess.

In an exemplary embodiment, the at least one angular protrusion is disposed on an outer surface of the extrusion channel, and the angular recess is disposed on an inner surface of the connection channel.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EXEMPLARY EMBODIMENTS

Exemplary embodiments of the present invention provide a low profile drain having a size that may be easily modified during installation, and which is configured to allow for improved installation, in which components of the low profile drain are securely and stably fixed to one another and securely and stably fixed within a floor. For example, according to exemplary embodiments, multiple extrusion channels may be connected to one another via a connection channel(s), thereby allowing for the size of the low profile drain to be easily modified during installation by connecting more or less extrusion channels to one another to achieve the desired size. The low profile drain may be, for example, a linear drain. However, the low profile drain is not limited thereto.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

It should be understood that descriptions of features or aspects within each exemplary embodiment should typically be considered as available for other similar features or aspects in other exemplary embodiments, unless the context clearly indicates otherwise.

As used herein, the singular forms "a", "an" and "the" are intended to include the plural forms as well, unless the context clearly indicates otherwise.

The term "about" as used herein is inclusive of the stated value and means within an acceptable range of deviation for the particular value as determined by one of ordinary skill in the art, considering the measurement in question and the error associated with measurement of the particular quantity (e.g., the limitations of the measurement system). For example, "about" may mean within one or more standard deviations as understood by one of the ordinary skill in the art. Further, it is to be understood that while parameters may be described herein as having "about" a certain value, according to exemplary embodiments, the parameter may be exactly the certain value or approximately the certain value within a measurement error as would be understood by a person having ordinary skill in the art.

Figure 1:
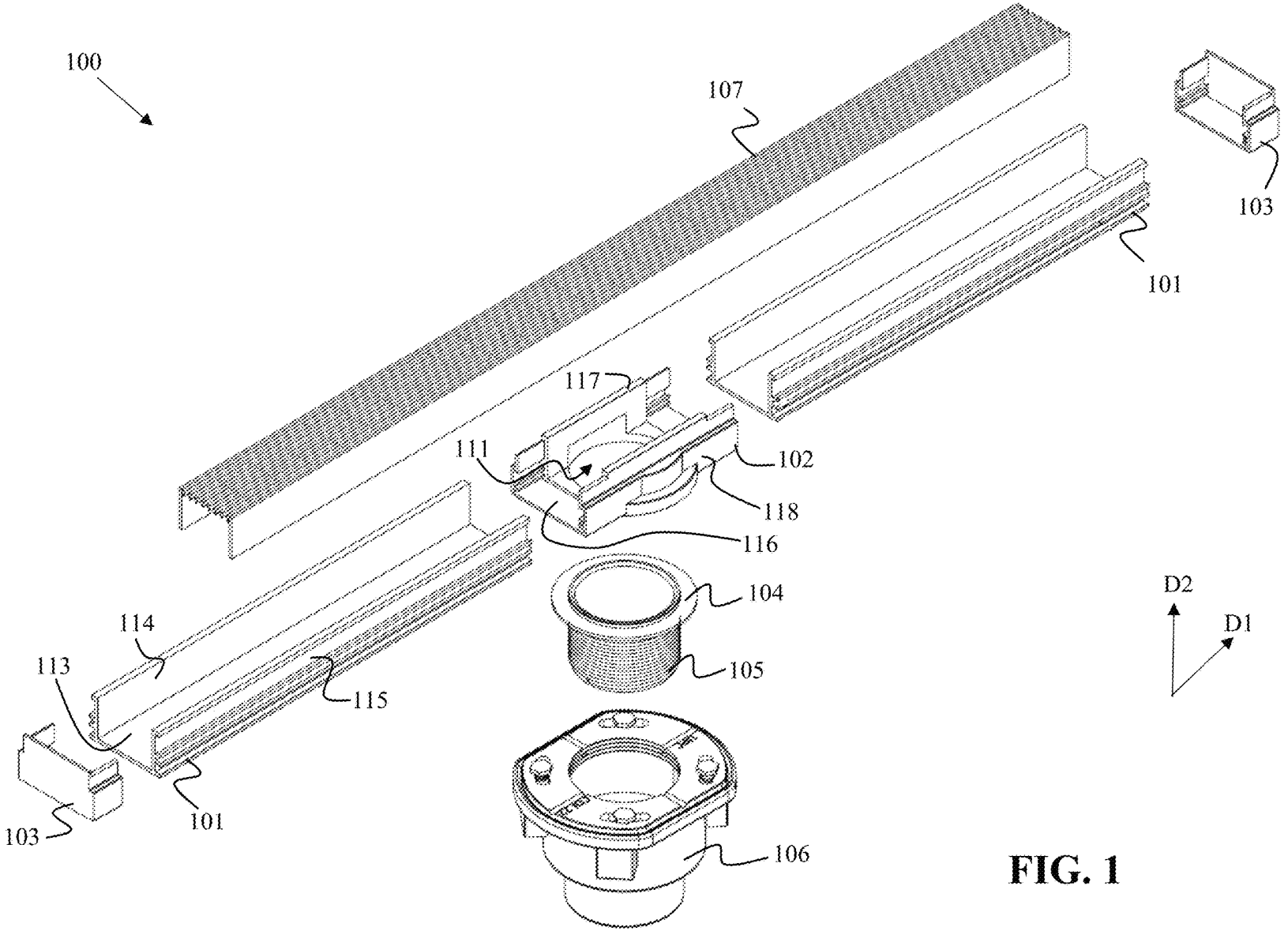
FIG. 1 is a perspective view illustrating a low profile drain according to an exemplary embodiment of the present invention.
Figure 2:
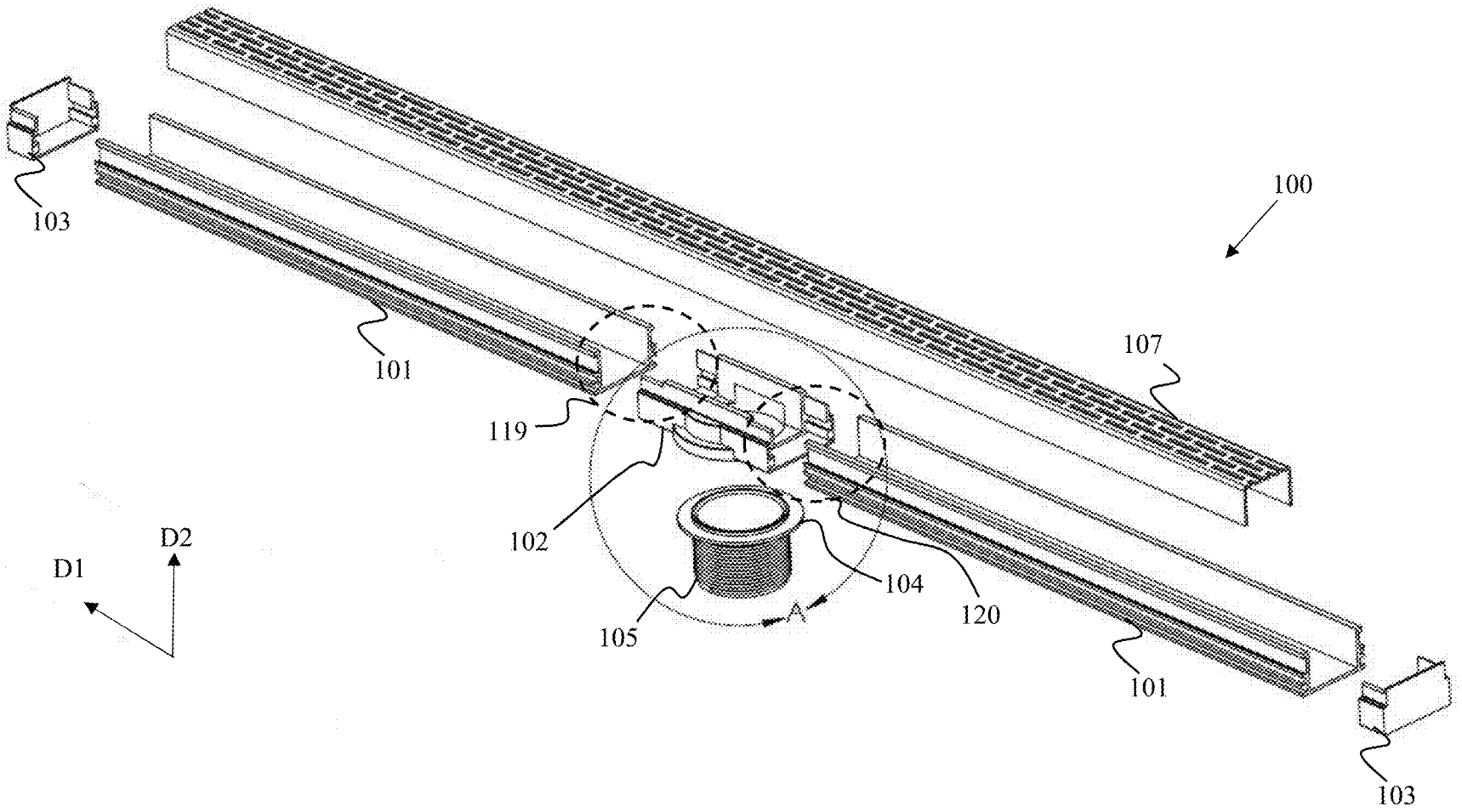
FIG. 2 is another perspective view illustrating the low profile drain of FIG. 1.

FIGS. 1 and 2 are perspective views illustrating a low profile drain 100 according to an exemplary embodiment of the present invention.

Referring to FIGS. 1 and 2, according to an exemplary embodiment, the low profile drain 100 may include extrusion channels 101, a connection channel 102, end caps 103, an outlet 104 including a threaded nipple 105, a drain body 106, and a grate 107. For convenience of explanation, an exemplary embodiment will be described herein in which the low profile drain 100 includes two extrusion channels 101 and one connection channel 102 connecting the two extrusion channels 101 to each other, as illustrated in FIGS. 1 and 2. However, the present invention is not limited thereto. For example, exemplary embodiments may include three or more extrusion channels 101 and/or two or more connection channels 102 connected to one another.

The connection channel 102 connects two extrusion channels 101 to each other. The connection channel 102 and the extrusion channels 101 may extend lengthwise in a first direction D1, and may be connected to one another in the first direction D1. The end caps 103 are connected to ends of the endmost extrusion channels 101 of the low profile drain 100 that are not connected to a connection channel 102. The size of the extrusion channels 101 may be modified by an installer during installation by cutting the extrusion channels 101 to the desired length. Thus, an installer may model the low profile drain 100 to the installation site. For example, an installer may cut the extrusion channels 101 in a variety of manners, allowing for the low profile drain 100 to be placed at any location in a room (e.g., in the center of a room, adjacent to a wall of a room, etc.). Thus, an installer may buy a drain kit in any variety of lengths (e.g., 2 foot, 4 foot, 8 foot, etc.), and may cut the extrusion channels 101 belonging to the drain kit down if a smaller size is desired.

Various materials may be used to form the components of the low profile drain 100 including, for example, polyvinyl chloride (PVC), acrylonitrile butadiene styrene (ABS) plastic, stainless steel, and/or a combination of these materials. However, the materials are not limited thereto.

Still referring to FIGS. 1 and 2, in an exemplary embodiment, the low profile drain 100 may include a first extrusion channel 101 extending lengthwise in the first direction D1, a second extrusion channel 101 extending lengthwise in the first direction D1, and a connection channel 102 extending lengthwise in the first direction D1 and connected between the first and second extrusion channels 101. The first extrusion channel 101 and the second extrusion channel 101 may include the same configuration. For example, each of the first extrusion channel 101 and the second extrusion channel 101 may include a lower surface 113, a first sidewall 114 extending upward from the lower surface 113 in a second direction D2 crossing the first direction D1, and a second sidewall 115 opposing the first sidewall 114 and extending upward from the lower surface 113 in the second direction D2. The connection channel 102 may include a lower surface 116, a first sidewall 117 extending upward from the lower surface 116 in the second direction D2, and a second sidewall 118 opposing the first sidewall 117 and extending upward from the lower surface 116 in the second direction D2. The connection channel 102 may be configured to interlock with an end of the first extrusion channel 101 via a first interlocking mechanism 119, and interlock with an end of the second extrusion channel 101 via a second interlocking mechanism 120.

When the low profile drain 100 is installed in a floor, mortar M (see FIG. 5) flows into and is embedded around the extrusion channels 101, the connection channel 102 and the end caps 103, such that the only portion visible when viewed from above are the top edges of the extrusion channels 101, the connection channel 102 and the end caps 103. Exemplary embodiments leverage this by designing the extrusion channels 101 and the connection channel 102 such that when mortar M flows into and is embedded around these components, the extrusion channels 101 and the connection channel 102 are securely locked together, as well as locked into the embedded mortar M, via the first interlocking mechanism 119 and the second interlocking mechanism 120, as described in further detail below. The first and second interlocking mechanisms 119 and 120 are circled by dotted lines in FIG. 2.

Figure 3:
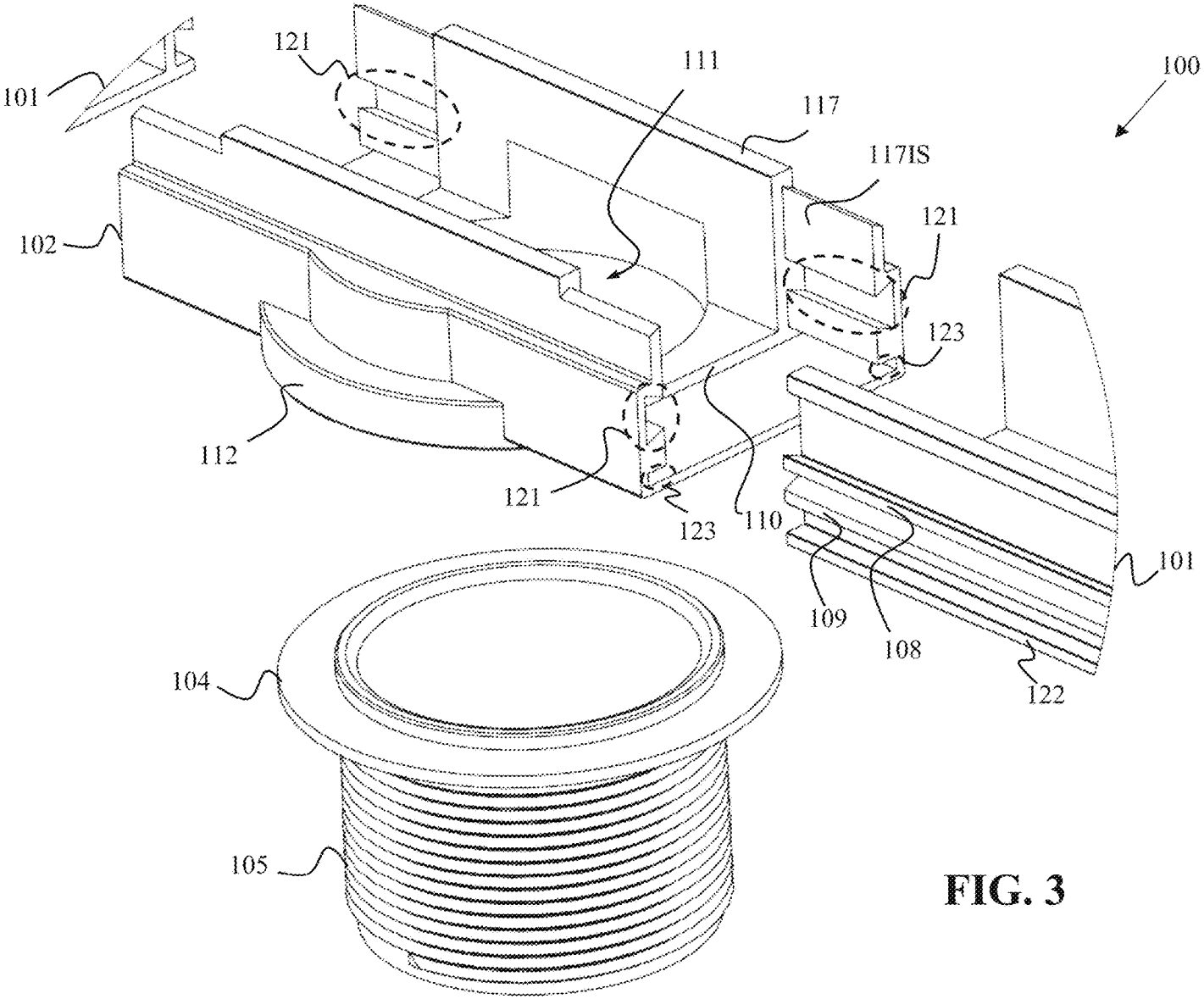
FIG. 3 is an enlarged view of portion A of FIG. 2.
Figure 4:
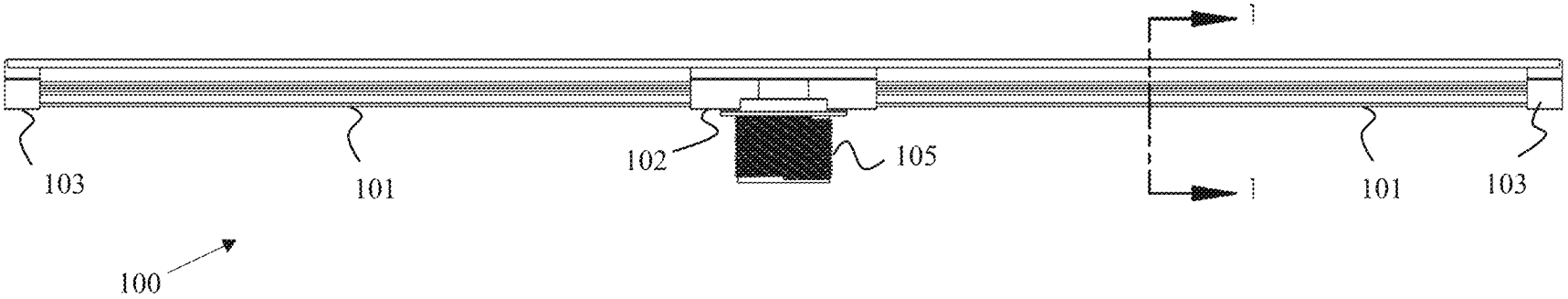
FIG. 4 is a side view illustrating the low profile drain of FIGS. 1 and 2.
Figure 5:
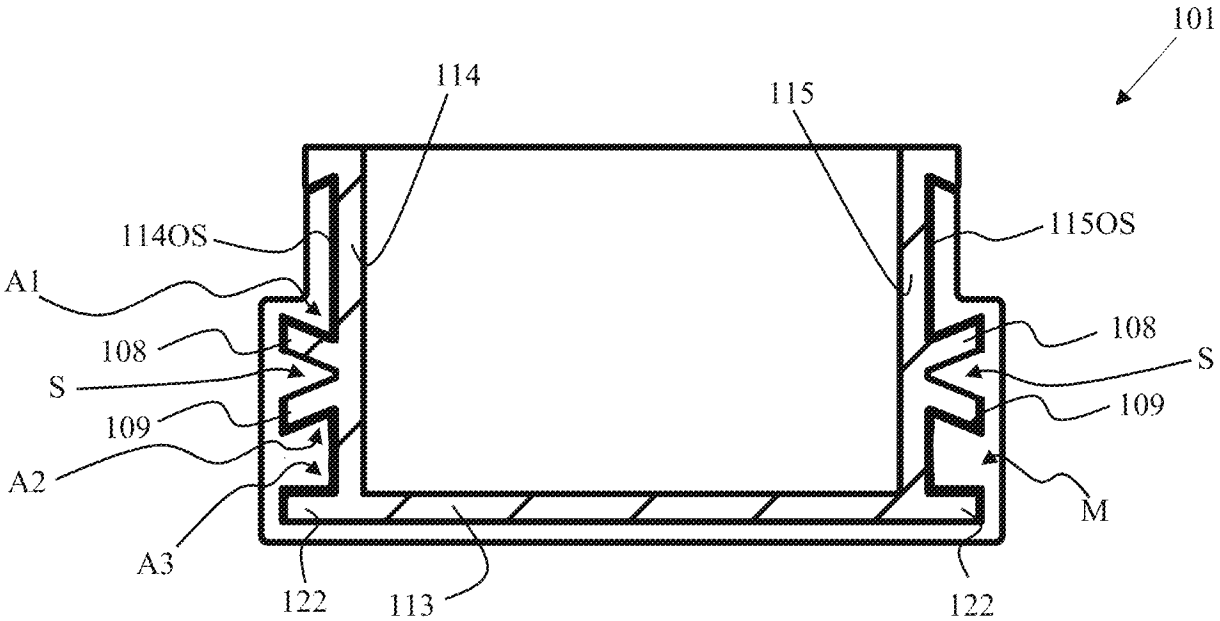
FIG. 5 is a cross-sectional view taken along line 1-1 of FIG. 4.

FIG. 3 is an enlarged view of portion A of FIG. 2. FIG. 4 is a side view illustrating the low profile drain 100 of FIGS. 1 and 2. FIG. 5 is a cross-sectional view taken along line 1-1 of FIG. 4. The cross-sectional view shown in FIG. 5 may be the same along the entirety of the extrusion channels 101.

Referring to FIGS. 1 to 5, in an exemplary embodiment, the first interlocking mechanism 119 may include a first angular protrusion 108 disposed on an outer surface 114OS of the first sidewall 114 of the first extrusion channel 101, a second angular protrusion 109 disposed on the outer surface 114OS of the first sidewall 114 of the first extrusion channel 101, and a first angular recess 121 disposed on an inner surface 117IS of the first sidewall 117 of the connection channel 102. The first angular recess 121 is shaped and dimensioned to receive the first and second angular protrusions 108 and 109 therein. The first angular recess 121 is circled by dotted lines in the FIG. 3. The first and second angular protrusions 108 and 109 may also be referred to herein as ribs. The first and second angular protrusions 108 and 109 extend away from each other as they protrude away from the outer surface 114OS of the first sidewall 114 of the first extrusion channel 101, and a space S exists between the first and second angular protrusions 108 and 109. The first and second angular protrusions 108 and 109 are configured to interlock with the first angular recess 121.

In addition, in an exemplary embodiment, the first interlocking mechanism 119 may further include an additional angular protrusion 122 disposed on the outer surface 114OS of the first sidewall 114 of the first extrusion channel 101, and an additional angular recess 123 disposed on the inner surface 117IS of the first sidewall 117 of the connection channel 102. The additional angular recess 123 may be shaped and dimensioned to receive the additional angular recess 123 therein. The additional angular recess 123 is circled by dotted lines in FIG. 3.

As shown in FIG. 5, since the first and second angular protrusions 108 and 109 protrude away from each other in different directions, a width of the space S between the first and second angular protrusions 108 and 109 may increase as the first and second angular protrusions 108 and 109 protrude away from the outer surface 114OS of the first sidewall 114 of the first extrusion channel 101. The space S formed between the first and second angular protrusions 108 and 109 may have a triangular shape, and may be filled with mortar M during installation, as described in further detail below.

Once the extrusion channels 101, the connection channel 102 and the end caps 103 have been interlocked with one another and placed into a floor, mortar M (see FIG. 5) is poured into and around the extrusion channels 101 and the connection channel 102. In FIG. 5, for convenience of illustration, the connection channel 102 and its recesses that respectively interlock with the angular protrusion 108, 109 and 122 of the extrusion channel 101 are not shown. It is to be understood that during installation, the mortar M shown in FIG. 5 flows between and is embedded between the angular protrusion 108, 109 and 122 of the extrusion channel 101 and the respective corresponding recesses 121 and 123 of the connection channel 102. Due to the angular shape of the angular protrusions 108, 109 and 122 and the respective corresponding angular recesses 121 and 123, the mortar M flows to and contacts the multiple surface areas provided by the angular shape. As a result, the extrusion channels 101 and the connection channel 102 are stably fixed together, and are stably fixed within the floor. The presence of the space S allows for the mortar M to further flow into the area between the extrusion channels 101 and the connection channel 102, for example, in an area located in the angular recess 121, further securing the components to one another and within the floor once the mortar M sets (e.g., dries). For example, when the mortar M is poured, it flows into all spaces and crevices between the extrusion channels 101 and the connection channel 102. Once the mortar M is set (e.g., dried), the extrusion channels 101 and the connection channel 102 are locked into place, and flexing of the components is prevented, thereby resulting in a low profile drain 100 having improved stability.

For example, due to the increased rigidity provided by the mortar M engaging the angular protrusions 108, 109 and/or 122 and their corresponding angular recesses 121 and/or 123, the extrusion channels 101 and the connection channel 102 are not easily pried up out of the floor, both during installation and after installation. For example, during installation, even when the mortar M is still soft (e.g., before the mortar M dries/sets), the mortar M provides stability to the extrusion channels 101 and the connection channel 102, thus improving installation by preventing the extrusion channels 101 and the connection channel 102 from being inadvertently moved out of place during installation. After installation, once the mortar M has set/dried, the low profile drain 100 is locked into place, and flexing of the low profile drain 100, for example, at locations at which the extrusion channels 101 and the connection channel 102 are coupled to one another, may be prevented.

Still referring to FIG. 5, in an exemplary embodiment, a first angle A1 formed between a side surface of the first angular protrusion 108 and the outer surface 114OS of the first sidewall 114 of the first extrusion channel 101 may be less than about 90 degrees, and a second angle A2 formed between a side surface of the second angular protrusion 109 and the outer surface 114OS of the first sidewall 114 of the first extrusion channel 101 may be less than about 90 degrees. For example, in an exemplary embodiment, the first angle may be about 45 degrees and the second angle A2 may be about 45 degrees. The first angle A1 and the second angle A2 may be about equal to each other. However, the present invention is not limited thereto. In an exemplary embodiment, a third angle A3 formed between a side surface of the additional angular protrusion 122 and the outer surface 114OS of the first sidewall 114 of the first extrusion channel 101 may be about 90 degrees.

The connection channel 102 may include a hole 111 disposed in the lower surface 116 thereof, and a lip 110 extending upward from the lower surface 116 (see FIG. 3). The lip 110 may be disposed between the hole 111 and an end of the connection channel 102. For example, the lip 110 may be disposed between the hole 111 and the angular recess 121 formed on the inner surface 117IS of the first sidewall 117 of the connection channel 102. The lip 110 may prevent the extrusion channel 101 from being pushed too far into the connection channel 102 when inserted. For example, when the extrusion channel 101 is inserted into the connection channel 102, the end of the lower surface 113 of the extrusion channel 101 contacts the lip 110. This prevents the extrusion channel 101 from accidentally covering a portion of the hole 111 formed in the connection channel 102 through which a liquid (e.g., water) flows. For example, when properly installed, liquid (e.g., water) flows through the grate 107 and the channel formed by the extrusion channels 101 and the connection channel 102, through the hole 111 of the connection channel 102, through the outlet 104, and down through a drainage system including, for example, a pipe connected to the threaded nipple 105. When installed, a hole in the outlet 104 is aligned with the hole 111, and is matingly received into an enclosure perimeter 112 formed on the bottom of the lower surface 116 of the connection channel 102. The enclosure perimeter 112 may surround the outlet 104 and fix the outlet 104 to the connection channel 102.

The first interlocking mechanism 119 may include the same configuration of angular protrusions 108, 109 and 122 on the outer surface 115OS of the second sidewall 115 of the first extrusion channel 101, as well as the same configuration of angular recesses 121 and 123 on the inner surface of the second sidewall 118 of the connection channel 102, which opposes the inner surface 117IS of the first sidewall 117, as described above. Exemplary embodiments may include some, but not all, of the angular protrusions 108, 109 and/or 122 and their corresponding angular recesses 121 and/or 123 on each respective sidewall.

The second interlocking mechanism 120 may include the same configuration of the first interlocking mechanism 119 described above, except that the angular protrusions 108, 109 and/or 122 are formed on the second extrusion channel 101, and the angular recesses 121 and/or 123 are formed on the other end of the connection channel 102.

The end caps 103 and the corresponding ends of the outermost extrusion channels 101 to which the end caps 103 are attached may form an interlocking mechanism having the same configuration as the first and second interlocking mechanism 119 and 120 described above.

Exemplary embodiments may further include additional extrusion channels 101 and connection channels 102 having the same configuration described above.

While the present invention has been particularly shown and described with reference to the exemplary embodiments thereof, it will be understood by those of ordinary skill in the art that various changes in form and detail may be made therein without departing from the spirit and scope of the present invention.

What is claimed is:

1. A low profile drain, comprising:

a first extrusion channel extending lengthwise in a first direction;

a second extrusion channel extending lengthwise in the first direction, wherein each of the first extrusion channel and the second extrusion channel comprises:

a lower surface;

a first sidewall extending upward from the lower surface in a second direction crossing the first direction; and a second sidewall opposing the first sidewall, and extending upward from the lower surface in the second direction;

a connection channel extending lengthwise in the first direction, and comprising:

a lower surface;

a first sidewall extending upward from the lower surface of the connection channel in the second direction; and a second sidewall opposing the first sidewall of the connection channel, and extending upward from the lower surface of the connection channel in the second direction, wherein the connection channel is configured to interlock with an end of the first extrusion channel via a first interlocking mechanism disposed on the first sidewall of the first extrusion channel and the first sidewall of the connection channel, and interlock with an end of the second extrusion channel via a second interlocking mechanism.

2. The low profile drain of claim 1, wherein the first interlocking mechanism comprises:

a first angular protrusion disposed on an outer surface of the first sidewall of the first extrusion channel;

a second angular protrusion disposed on the outer surface of the first sidewall of the first extrusion channel, wherein the first and second angular protrusions extend away from each other as the first and second angular protrusions protrude away from the outer surface of the first sidewall of the first extrusion channel, and a first space exists between the first and second angular protrusions; and a first angular recess disposed on an inner surface of the first sidewall of the connection channel, wherein the first and second angular protrusions are configured to interlock with the first angular recess.

3. The low profile drain of claim 2, wherein the first interlocking mechanism further comprises:

a third angular protrusion disposed on an outer surface of the second sidewall of the first extrusion channel;

a fourth angular protrusion disposed on the outer surface of the second sidewall of the first extrusion channel, wherein the third and fourth angular protrusions extend away from each other as the third and fourth angular protrusions protrude away from the outer surface of the second sidewall of the first extrusion channel, and a second space exists between the third and fourth angular protrusions; and a second angular recess disposed on an inner surface of the second sidewall of the connection channel, wherein the third and fourth angular protrusions are configured to interlock with the second angular recess.

4. The low profile drain of claim 2, wherein the second interlocking mechanism comprises:

a fifth angular protrusion disposed on an outer surface of the first sidewall of the second extrusion channel;

a sixth angular protrusion disposed on the outer surface of the first sidewall of the second extrusion channel, wherein the fifth and sixth angular protrusions extend away from each other as the fifth and sixth angular protrusions protrude away from the outer surface of the first sidewall of the second extrusion channel, and a third space exists between the fifth and sixth angular protrusions; and a third angular recess disposed on the inner surface of the first sidewall of the connection channel, wherein the fifth and sixth angular protrusions are configured to interlock with the third angular recess.

5. The low profile drain of claim 4, wherein the second interlocking mechanism further comprises:

a seventh angular protrusion disposed on an outer surface of the second sidewall of the second extrusion channel;

an eighth angular protrusion disposed on the outer surface of the second sidewall of the second extrusion channel, wherein the seventh and eighth angular protrusions extend away from each other as the seventh and eighth angular protrusions protrude away from the outer surface of the second sidewall of the second extrusion channel, and a fourth space exists between the seventh and eighth angular protrusions; and a fourth angular recess disposed on the inner surface of the second sidewall of the connection channel, wherein the seventh and eighth angular protrusions are configured to interlock with the fourth angular recess.

6. The low profile drain of claim 2, wherein a width of the first space between the first and second angular protrusions increases as the first and second angular protrusions protrude away from the outer surface of the first sidewall of the first extrusion channel.

7. The low profile drain of claim 2, wherein the first angular recess is shaped and dimensioned to receive the first and second angular protrusions.

8. The low profile drain of claim 2, wherein a first angle formed between a side surface of the first angular protrusion and the outer surface of the first sidewall of the first extrusion channel is less than about 90 degrees.

9. The low profile drain of claim 8, wherein a second angle formed between a side surface of the second angular protrusion and the outer surface of the first sidewall of the first extrusion channel is less than about 90 degrees.

10. The low profile drain of claim 2, wherein a first angle formed between a side surface of the first angular protrusion and the outer surface of the first sidewall of the first extrusion channel is about 45 degrees.

11. The low profile drain of claim 10, wherein a second angle formed between a side surface of the second angular protrusion and the outer surface of the first sidewall of the first extrusion channel is about 45 degrees.

12. The low profile drain of claim 2, wherein the first space has a triangular shape.

13. The low profile drain of claim 1, wherein the connection channel further comprises:

a hole disposed in the lower surface of the connection channel.

14. The low profile drain of claim 13, further comprising:

a lip extending upward from the lower surface of the connection channel, wherein the lip is disposed between the hole and an end of the connection channel.

15. The low profile drain of claim 13, further comprising:

a lip extending upward from the lower surface of the connection channel, wherein the lip is disposed between the hole and an angular recess formed in an inner surface of the first sidewall of the connection channel.

16. A low profile drain, comprising:

a first extrusion channel extending lengthwise in a first direction, and comprising a lower surface, and a first sidewall extending upward from the lower surface in a second direction crossing the first direction;

a second extrusion channel extending lengthwise in the first direction; and a connection channel extending lengthwise in the first direction, and comprising a lower surface, and a first sidewall extending upward from the lower surface of the connection channel in the second direction, wherein the connection channel is configured to interlock with an end of the first extrusion channel via a first interlocking mechanism disposed on the first sidewall of the first extrusion channel and the first sidewall of the connection channel, and interlock with an end of the second extrusion channel via a second interlocking mechanism, wherein the first interlocking mechanism comprises:

at least one first angular protrusion disposed on the first sidewall of the first extrusion channel; and a first angular recess disposed on the first sidewall of the connection channel, wherein the at least one first angular protrusion is configured to interlock with the first angular recess.

17. The low profile drain of claim 16, wherein the second interlocking mechanism comprises:

at least one second angular protrusion disposed on the second extrusion channel; and a second angular recess disposed on the connection channel, wherein the at least one second angular protrusion is configured to interlock with the second angular recess.

18. The low profile drain of claim 17, wherein the at least one first angular protrusion is disposed on an outer surface of the first extrusion channel, and the first angular recess is disposed on an inner surface of the connection channel, wherein the at least one second angular protrusion is disposed on an outer surface of the second extrusion channel, and the second angular recess is disposed on the inner surface of the connection channel.

19. A low profile drain, comprising:

an extrusion channel extending lengthwise in a first direction, and comprising a lower surface, and a first sidewall extending upward from the lower surface in a second direction crossing the first direction; and a connection channel extending lengthwise in the first direction, and comprising a lower surface, and a first sidewall extending upward from the lower surface of the connection channel in the second direction, wherein the connection channel is configured to interlock with an end of the extrusion channel via an interlocking mechanism disposed on the first sidewall of the first extrusion channel and the first sidewall of the connection channel, wherein the interlocking mechanism comprises:

at least one angular protrusion disposed on the first sidewall of the extrusion channel; and an angular recess disposed on the first sidewall of the connection channel, wherein the at least one angular protrusion is configured to interlock with the angular recess.

20. The low profile drain of claim 19, wherein the at least one angular protrusion is disposed on an outer surface of the first sidewall of the extrusion channel, and the angular recess is disposed on an inner surface of the first sidewall of the connection channel.

* * * * *